US008777505B2

(12) United States Patent
Thorez

(10) Patent No.: US 8,777,505 B2
(45) Date of Patent: Jul. 15, 2014

(54) PRODUCT DISPENSER FOR DISPENSING AN ELONGATE PRODUCT STRIP

(75) Inventor: Gaël Thorez, Voisins le Bretonneux (FR)

(73) Assignee: ALBEA Services, Gennevilliers (FR)

( * ) Notice: Subject to any disclaimer, the term of this patent is extended or adjusted under 35 U.S.C. 154(b) by 107 days.

(21) Appl. No.: 13/217,737

(22) Filed: Aug. 25, 2011

(65) Prior Publication Data

US 2012/0076566 A1 Mar. 29, 2012

(30) Foreign Application Priority Data

Aug. 27, 2010 (EP) ..... 10305923

(51) Int. Cl.
*B43M 11/06* (2006.01)

(52) U.S. Cl.
USPC ..... 401/265; 401/263; 401/186

(58) Field of Classification Search
USPC ..... 401/261, 262, 263, 265, 183–186; 222/207, 547, 564
See application file for complete search history.

(56) References Cited

U.S. PATENT DOCUMENTS 2,942,762 A 6/1960 Morris
4,749,108 A 6/1988 Dornsbusch et al.
4,941,598 A 7/1990 Lambelet, Jr. et al.
5,902,060 A * 5/1999 Rodriguez ..... 401/1
7,824,123 B2 * 11/2010 Liberatore ..... 401/266
7,841,793 B2 * 11/2010 Ramet ..... 401/11

FOREIGN PATENT DOCUMENTS

WO 2010046921 A2 4/2010

OTHER PUBLICATIONS

European Search Report in corresponding European Patent Application No. EP 10305923, dated Dec. 10, 2010.

* cited by examiner

*Primary Examiner* — David Walczak
(74) *Attorney, Agent, or Firm* — Banner & Witcoff, Ltd.

(57) ABSTRACT

A product dispenser for dispensing an elongate product strip includes, in one embodiment, a product container for storing the product to be dispensed, the container defining an opening through which the product can exit the container, a product flow regulator and a dispensing cover that overlies the product flow regulator. The product flow regulator is positioned proximate the container opening and comprises a flow passage that is in communication with the product container, the flow passage accommodating the product exiting the container. The product flow regulator terminates in at least one distribution aperture for allowing the product within the flow passage to exit the product flow regulator, the product flow regulator further comprising a reservoir for accommodating the product exiting the product flow regulator. The dispensing cover defines an elongate distribution slit proximate the reservoir of the product flow regulator, for allowing an elongate product strip to be dispensed.

10 Claims, 9 Drawing Sheets

PRODUCT DISPENSER FOR DISPENSING AN ELONGATE PRODUCT STRIP

CROSS-REFERENCE TO RELATED APPLICATION

This application claims priority to European Application EP 10305923.4, filed Aug. 27, 2010, the entire disclosure of which is hereby incorporated by reference.

FIELD OF THE INVENTION

This invention relates to a product dispenser for dispensing an elongate product strip.

BACKGROUND OF THE INVENTION

Certain products, such as certain skincare creams and lotions, are better applied when they are applied as elongate strips rather than as a single dose that then has to be spread out over the area to be treated using a tool or with fingers. This, for example, would enable the desired area on a person's body to be neatly covered in a single, controlled movement.

The aim of the present invention is therefore to provide a product dispenser for dispensing an elongate product strip. In particular, the product dispenser aims to allow the even distribution of a strip of product that is uniform both in thickness and in width in a controlled manner.

SUMMARY OF THE INVENTION

According to the invention there is provided a product dispenser for dispensing an elongate product strip, the product dispenser comprising: a product container for storing the product to be dispensed, the container defining an opening through which the product can exit the container; a product flow regulator proximate the container opening, the product flow regulator comprising a flow passage that is in communication with the product container, the flow passage accommodating the product exiting the container, the product flow regulator terminating in at least one distribution aperture for allowing the product within the flow passage to exit the product flow regulator, the product flow regulator further comprising a reservoir for accommodating the product exiting the product flow regulator; and a dispensing cover overlying the product flow regulator, the dispensing cover defining an elongate distribution slit proximate the reservoir of the product flow regulator, for allowing an elongate product strip to be dispensed.

In an embodiment, the reservoir is substantially elongate, and is positioned substantially parallel to the elongate distribution slit of the dispensing cover.

In an embodiment, the product container comprises a spout that defines the container opening, the product flow regulator being securable to the spout of the product container.

In an embodiment, the product flow regulator comprises: a conduit that defines the flow passage, the conduit comprising a first, open end snugly fitted within the spout of the product container to receive product exiting the container, and a second end in which the at least one distribution aperture is defined; a skirt extending from the conduit, proximate the first end of the conduit, the skirt and spout comprising complementary securing formations to enable the skirt, and thus the product flow regulator, to be secured to the spout of the product container; and a rectangular bowl portion extending from the conduit, proximate the second end of the conduit, the bowl portion defining the reservoir for accommodating the product exiting the product flow regulator through the at least one distribution aperture.

In an embodiment, the dispensing cover and the skirt comprise complementary securing formations to enable the dispensing cover to be secured to the product flow regulator.

In an embodiment, proximate the elongate distribution slit, the dispensing cover comprises a rectangular guide wall that can be snugly accommodated within the rectangular bowl portion of the product flow regulator, thereby guiding the flow of product from the reservoir through the elongate distribution slit.

In an embodiment, the at least one distribution aperture faces sideways or downwards towards the base of the bowl portion, thereby ensuring that the reservoir is filled completely before the product is dispensed through the elongate distribution slit.

In an embodiment, the product container comprises a flexible wall container such as a tube.

Alternatively, the product container may comprise a rigid wall container fitted with a dispensing mechanism.

In an embodiment, the product dispenser is arranged to dispense an elongate product strip having a length of approximately between 2.5 and 3 cm.

In an embodiment, the product dispenser comprises a cap that is releasably fittable to the dispensing cover.

DESCRIPTION OF PREFERRED EMBODIMENTS

Figure 1:
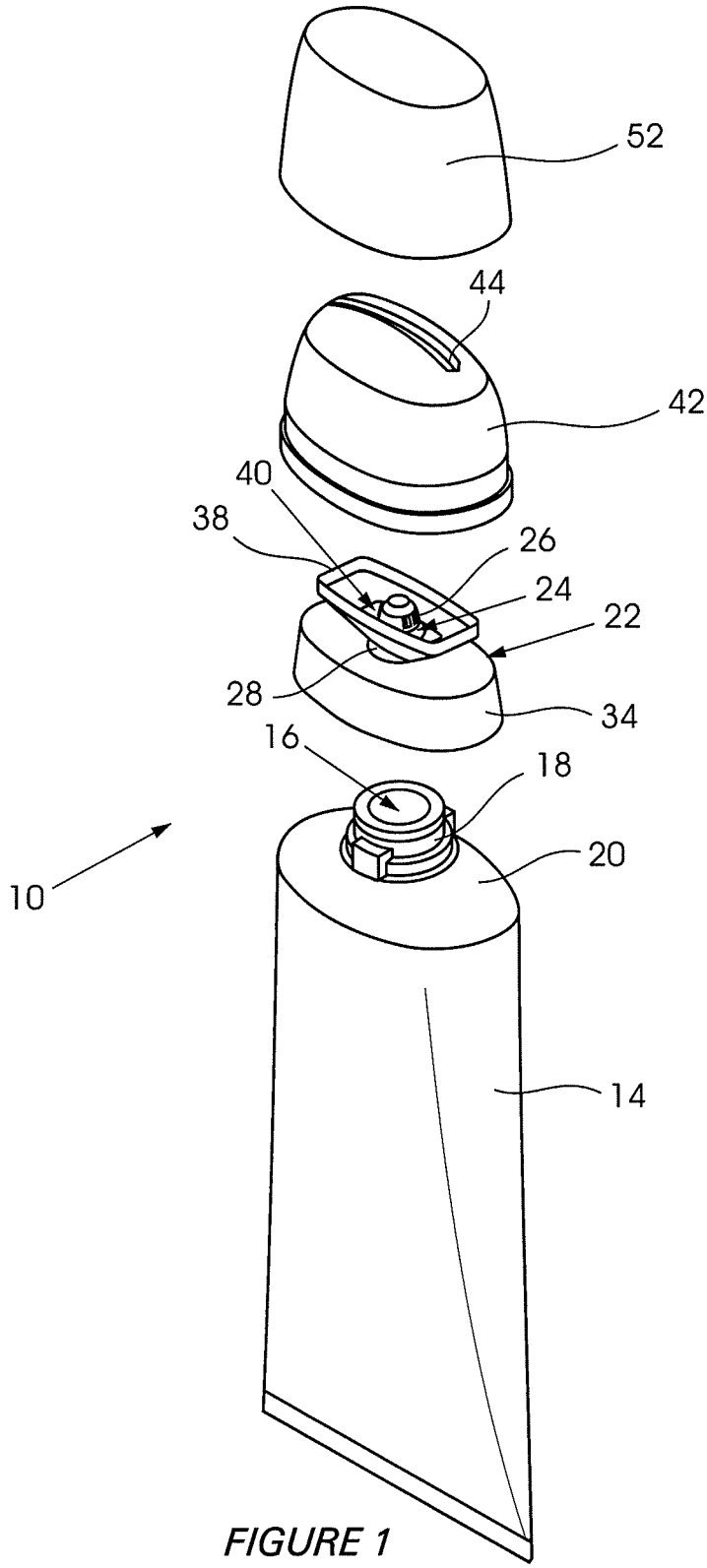
FIG. 1 shows an exploded, perspective view of a product dispenser for dispensing an elongate product strip, according to an example embodiment.
Figure 2:
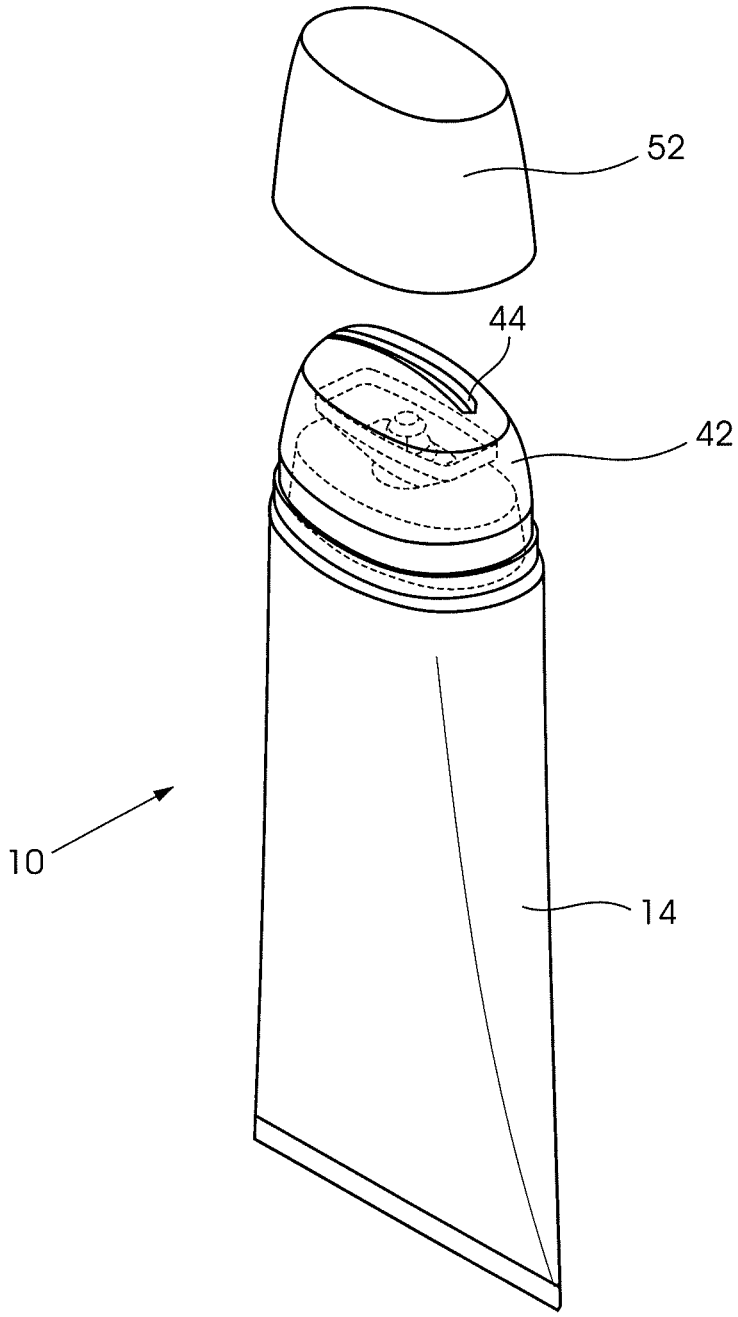
FIG. 2 shows a perspective view of the product dispenser shown in FIG. 1 in an assembled configuration, except for a cap that is shown separated from the product dispenser.
Figure 3:
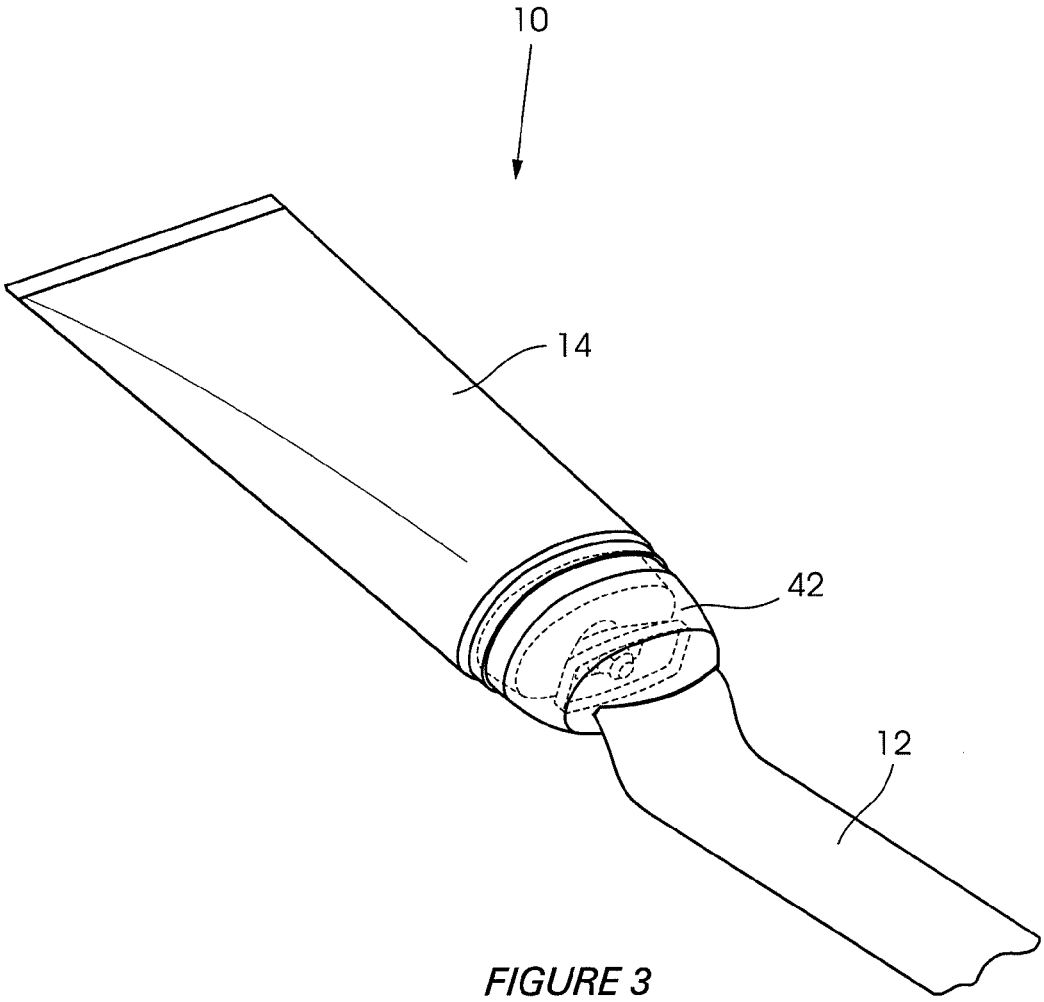
FIG. 3 shows a perspective view of the product dispenser in use, namely dispensing an elongate product strip.
Figure 4:
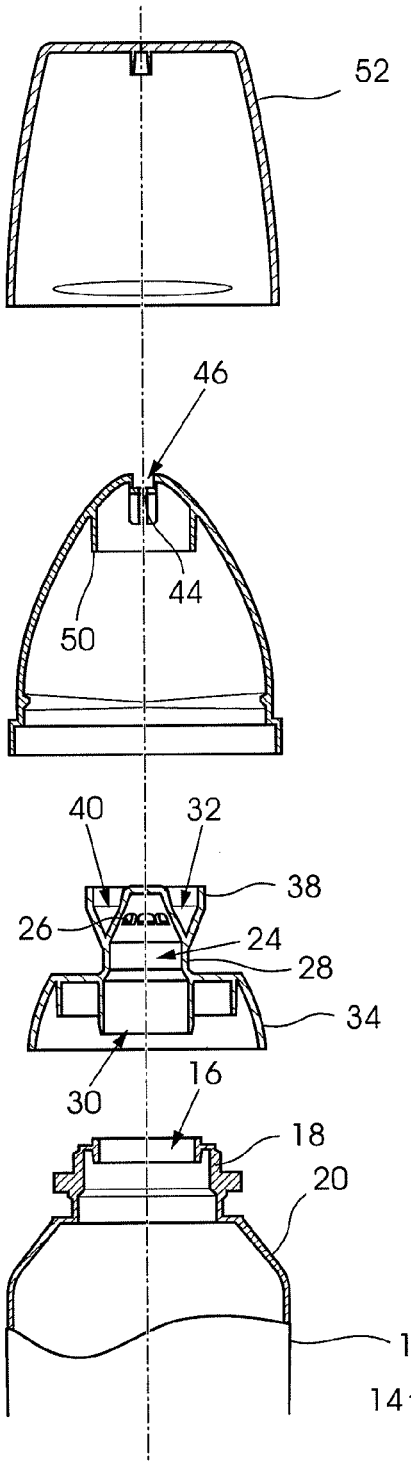
FIGS. 4 and 5 show side-by-side, exploded, cross-sectional side and front views, respectively, of an upper portion of the product dispenser of the invention.
Figure 5:
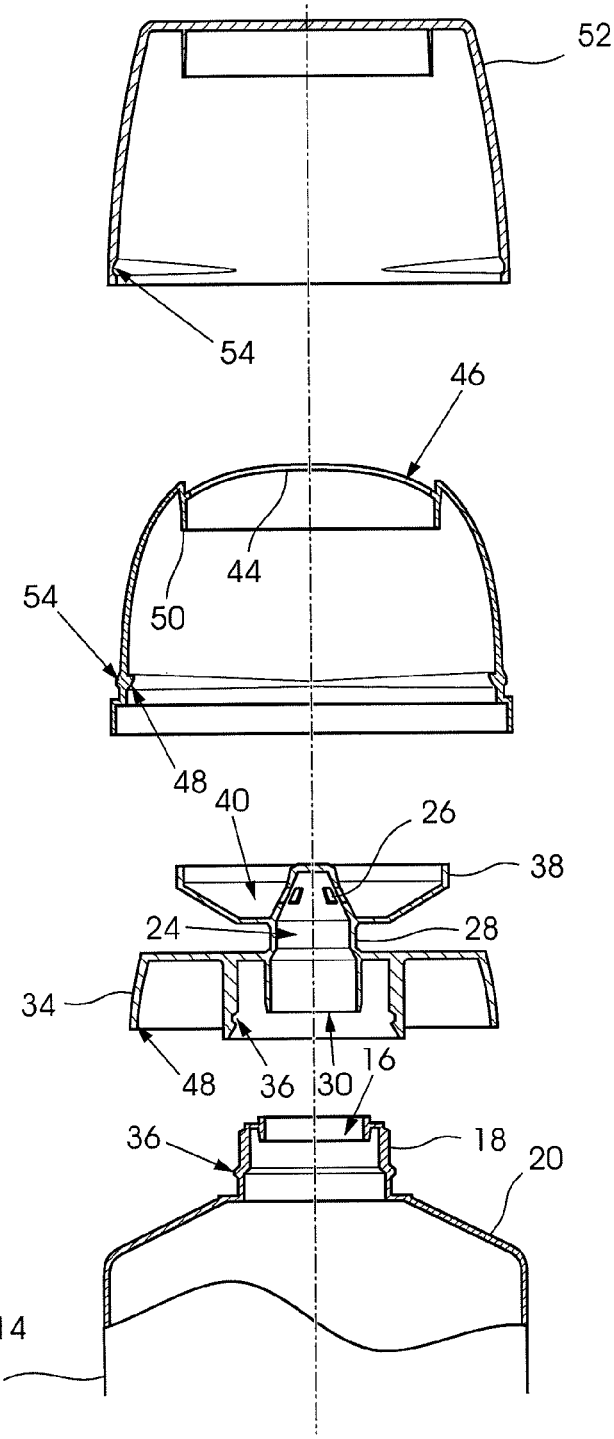
Figure 6:
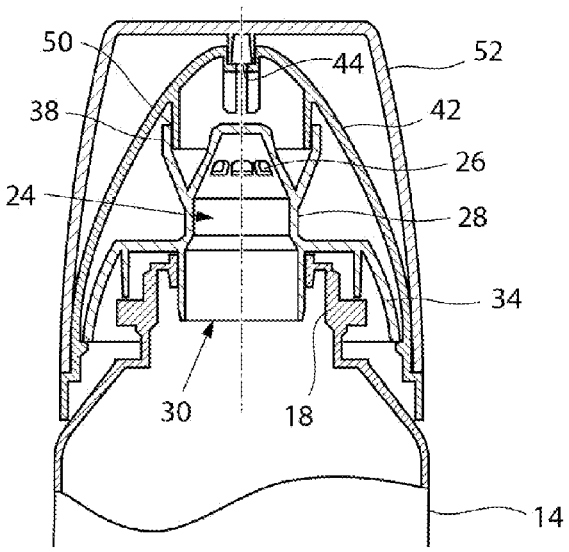
FIGS. 6 and 7 show assembled, cross-sectional side and front views, respectively, of an upper portion of the product dispenser of the invention.
Figure 7:
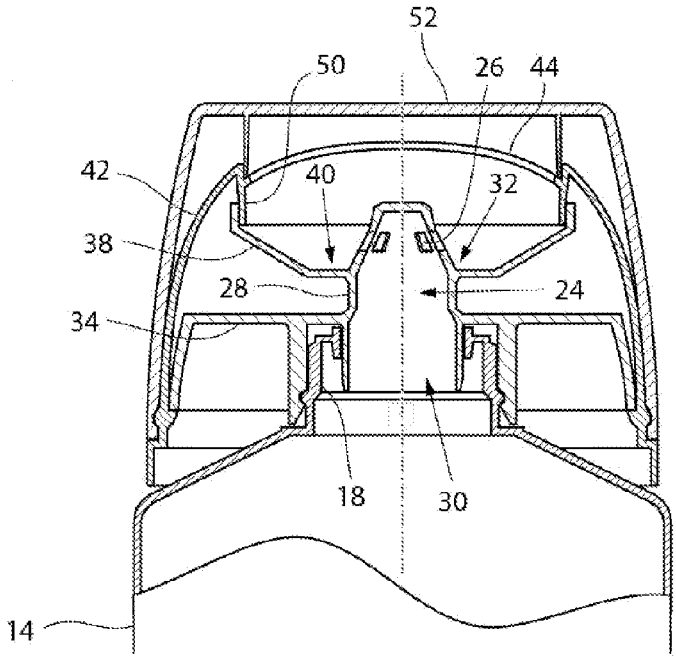
Figure 8:
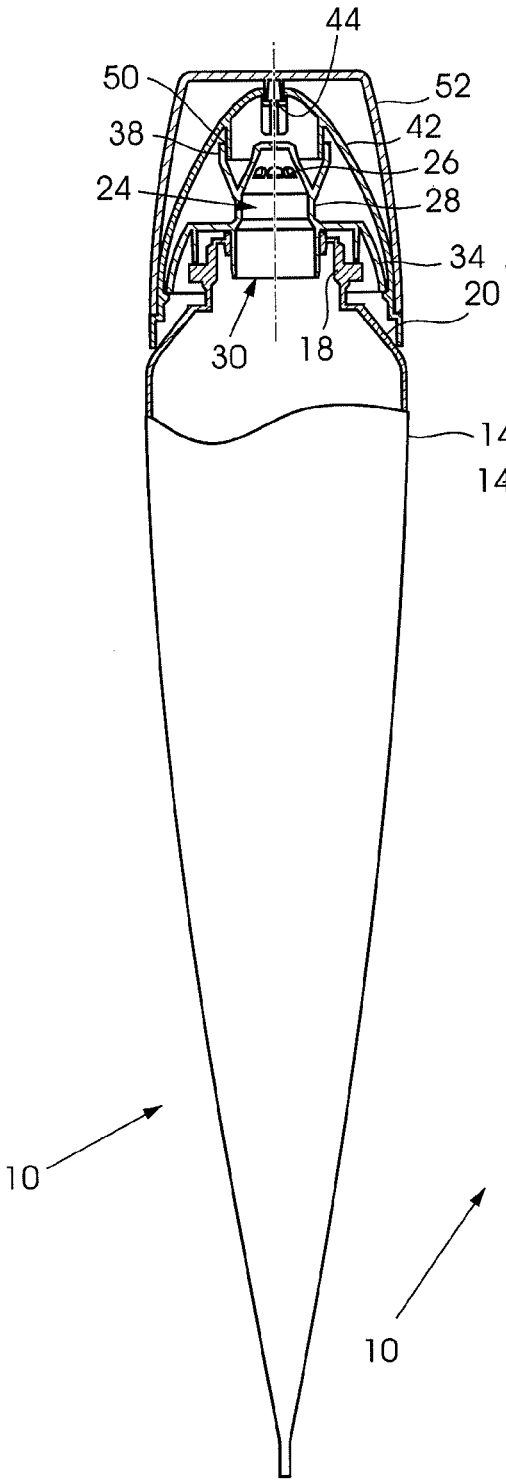
FIGS. 8 and 9 show assembled, cross-sectional side and front views, respectively, of the product dispenser of the invention.
Figure 9:
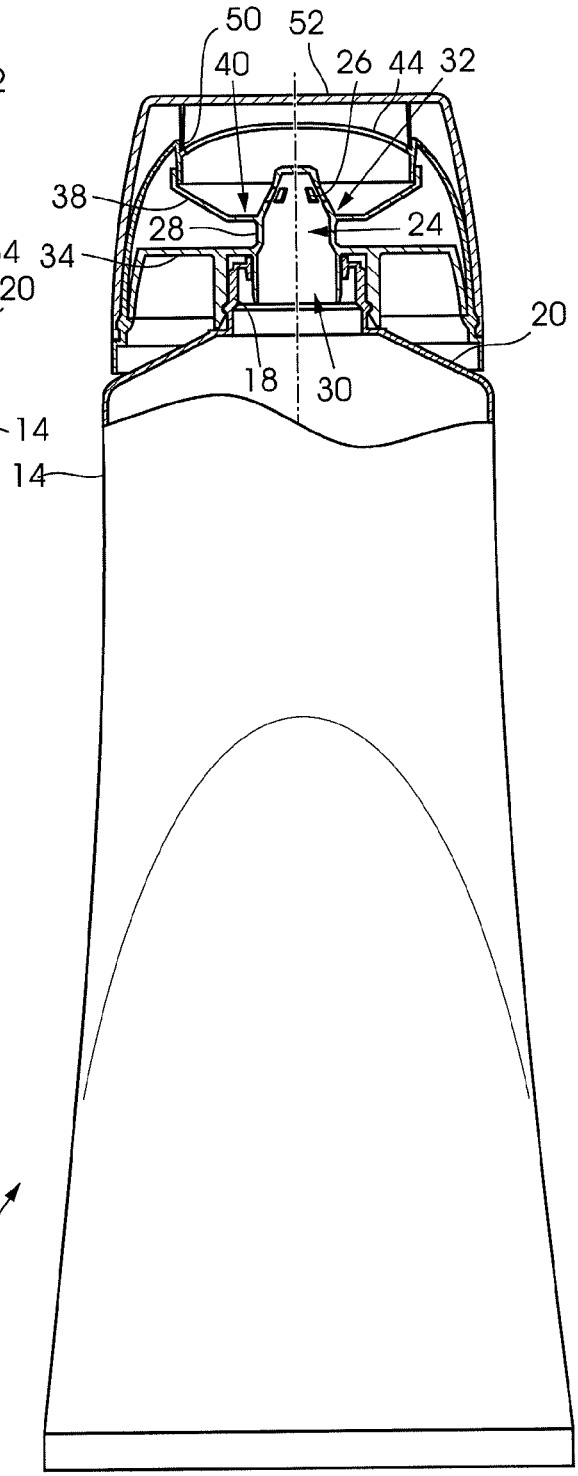
Figure 10:
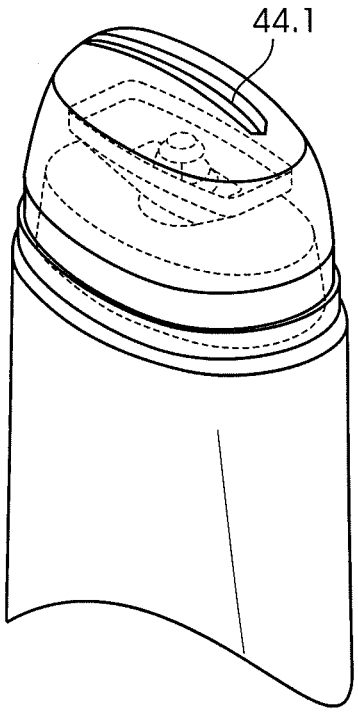
FIGS. 10 to 16 show perspective views of alternative embodiments of the product dispenser of the invention.
Figure 11:
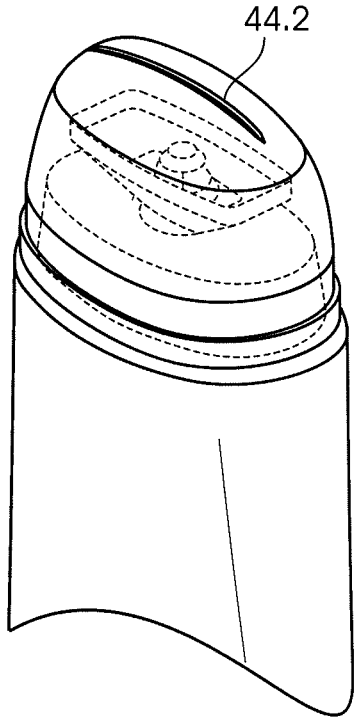
Figure 12:
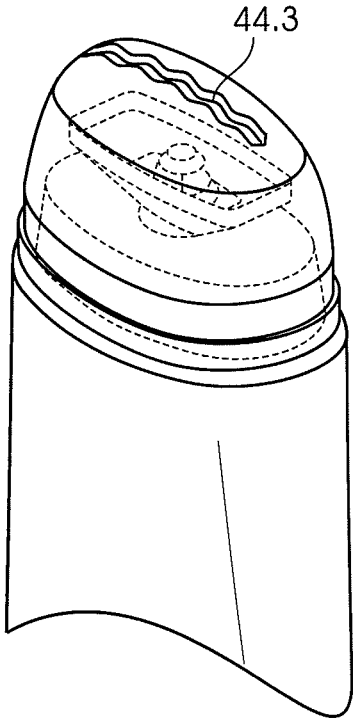

Referring first to FIGS. 1 to 9, a product dispenser 10 for dispensing an elongate product strip 12, as best shown in FIG. 3, is shown. The product dispenser 10 comprises a product container 14 for storing the product to be dispensed, with the container 14 defining an opening 16 through which the product 12 can exit the container 14.

In an embodiment, the product container 14 terminates in a spout 18 that projects from a shoulder portion 20 of the product container 14, the spout defining the container opening 16.

In the illustrated embodiment, the product container 14 comprises a flexible wall container such as a tube. Alternatively, however, the product container 14 may comprise a rigid wall container fitted with a dispensing mechanism to dispense the product within the container 14.

As best shown in FIGS. 1 and 4 to 9, the product dispenser 10 further comprises a product flow regulator 22 that can be secured to the product container 14, and in particular to the spout 18 of the container 14, so as to be located proximate the container opening 16. With particular reference to FIGS. 4 to 7, the product flow regulator 22 comprises a flow passage 24 that is in communication with the product container 14. The flow passage 24 accommodates the product 12 exiting the container 14, with the product flow regulator 22 terminating in a plurality of central distribution apertures 26 for allowing the product 12 within the flow passage 24 to exit the product flow regulator 22.

In particular, the product flow regulator 22 comprises a conduit 28 that defines the flow passage 24. The conduit 28, in turn, comprises a first, open end 30 snugly fitted within the spout 18 of the product container 14 to receive product exiting the container 14, and a second end 32 in which the distribution apertures 26 are defined.

A skirt 34 extends from the conduit 28, proximate the first end 30 of the conduit 28. The skirt 34 and spout 18 comprise complementary securing snap fit formations 36 to enable the skirt 34, and thus the product flow regulator 22, to be secured to the spout 18 of the product container 14.

A rectangular bowl portion 38 extends from the conduit 28, proximate the second end 32 of the conduit 28. The bowl portion 38 defines a reservoir 40 for accommodating the product 12 exiting the product flow regulator 22 through the distribution apertures 26.

The product dispenser 10 further comprises a dispensing cover 42 that overlies the product flow regulator 22. The dispensing cover 42 defines a central elongate distribution slit 44 proximate the reservoir 40 of the product flow regulator 22. This arrangement allows an elongate product strip 12 to be dispensed, as best shown in FIG. 3.

In an embodiment, the elongate distribution slit 44 is defined within an elongate recess 46 defined in the dispensing cover 42. Conveniently, the reservoir 40 is substantially elongate, and is positioned substantially parallel to the elongate distribution slit 44 of the dispensing cover 42. This arrangement allows product to flow and accumulate into the reservoir 40 in a controlled manner. In particular, the product flow regulator 22 controls the flow of product towards the slit 44, and the shape and positioning of the distribution slit 44 relative to the reservoir 40 (i.e. that they are essentially parallel to each other) further controls and regulates the dispensing of the product 12.

In particular, the pattern of product flow creates a pressure gradient in the reservoir 40, which allows the reservoir 40 to fill completely before the product is dispensed through the slit 44. As the product enters the reservoir 40, it will accumulate around the distribution apertures 26 in regions of relatively high product pressure, but eventually, as the product 12 moves to regions within the reservoir 40 of relatively lower pressure, it will distribute evenly in the reservoir 40 before exiting through the slit 44. Advantageously, in this regard, the apertures 26 face sideways or downwards towards the base of the bowl portion 38, and not upwards towards the slit 44. This arrangement ensures that the reservoir 40 is filled completely before the product is dispensed through the slit 44. The result is that the pressure becomes essentially even across the entire length of the slit 44, thereby ensuring an even flow of an essentially constant rate of product. As a user of the product dispenser 10 draws the device across the portion of the body to be treated, an elongate strip of product is hence formed. An essentially constant pressure, and hence constant flow rate along the length of the slit 44, leads to the formation of a strip 12 of essentially uniform thickness.

The thickness of the dispensed product strip 12 also depends upon the pressure applied by the user to the product container 14 (either directly in the case of the container 14 taking the form of a flexible tube or via the dispensing mechanism in the case of the container 24 taking the form of a rigid wall container). A further factor affecting the thickness of the dispensed product strip 12 is the viscosity of the product 12. Thus, to summarise, the thickness of the strip 12 is defined by the speed at which the user draws the product dispenser 10 over the zone to be treated, the pressure applied by the user to the product container 14, and the viscosity of the product 12. Thus, for example, for a given applied pressure and viscosity, the slower the movement of the product dispenser 10 the thicker the strip, and vice versa. Similarly, for a given speed of movement and viscosity, the greater the applied pressure to the container 14, the thicker the strip, and vice versa. However, the strip width is defined by the geometry of the slit 44, which remains constant irrespective of the pressure applied or the speed of movement defined by the user.

In an embodiment, the dispensing cover 42 and the skirt 34 comprise complementary securing snap fit formations 48 to enable the dispensing cover 42 to be secured to the product flow regulator 22.

Proximate the elongate distribution slit 44, the dispensing cover 42 comprises a rectangular guide wall 50 that can be snugly accommodated within the rectangular bowl portion 38 of the product flow regulator 22, as best shown in FIGS. 6 to 9, thereby guiding the flow of product 12 from the reservoir 40 through the elongate distribution slit 44.

A cap 52 may be provided that is releasably fittable to the dispensing cover 42, again typically using snap fit formations 54.

In an embodiment, the product dispenser 10 is arranged to dispense an elongate product strip 12 having a length of approximately between 2.5 and 3 cm, with the product typically having a viscosity of between 83,100 to 155,700 mPA*s and a restitution rate of between 90%-96% (but this does depend on the product's viscosity).

Figure 13:
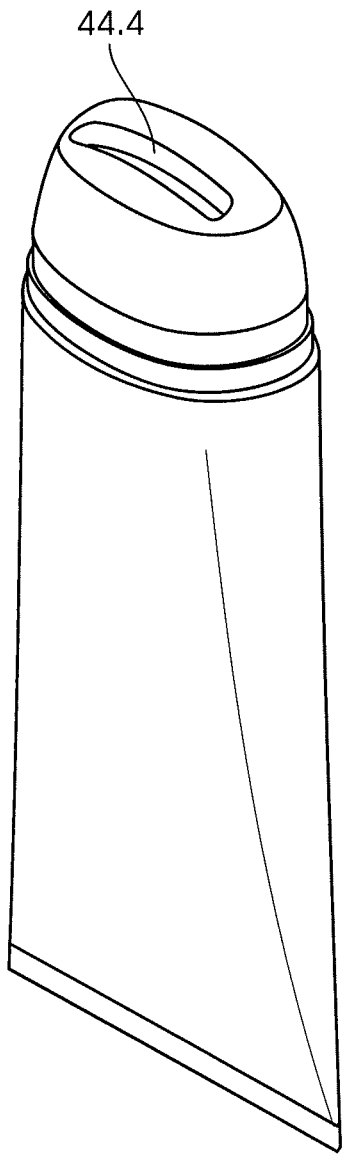
Figure 14:
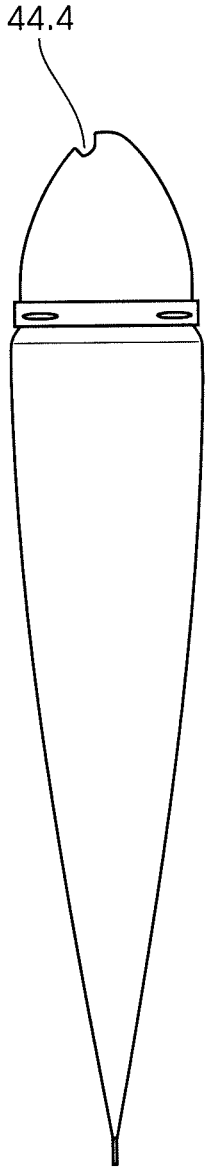
Figure 15:
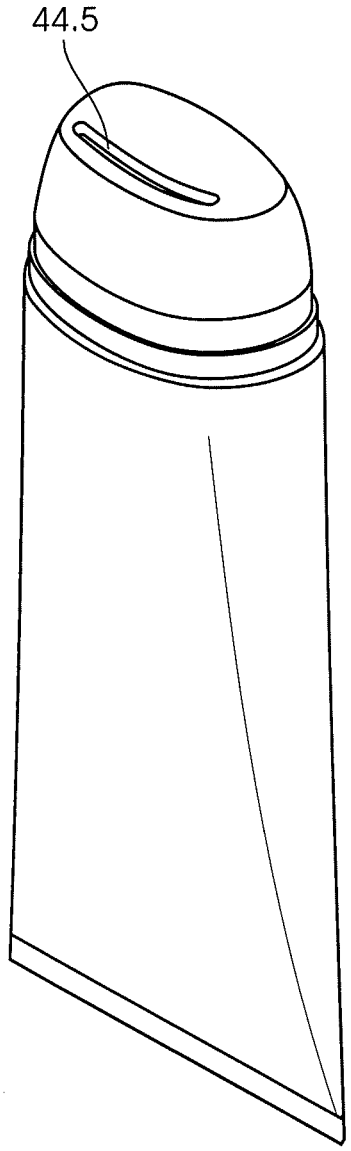
Figure 16:
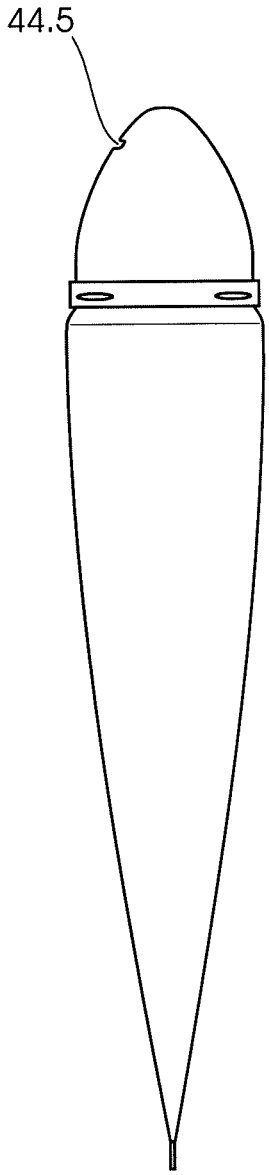

Turning now to FIGS. 10 to 16, alternative embodiments of the product dispenser of the invention. For example, the elongate distribution slit 44 may be relatively wide (as indicated by numeral 44.1 in FIG. 10) or relatively narrow (as indicated by numeral 44.2 in FIG. 11). In one version, the distribution slit 44, although elongate, may be wavy, as indicated by numeral 44.3 in FIG. 12. In addition, the slit 44 may be defined off-centre to facilitate application of the dispensed product, as shown in FIGS. 13 to 16, with FIGS. 13 and 14 showing a relatively wider slit 44.4 and FIGS. 15 and 16 a relatively narrower slit 44.5.

The present invention thus provides a product dispenser for dispensing an elongate product strip in a controlled manner and having an even distribution of product.

The invention claimed is:

1. A product dispenser for dispensing an elongate product strip, the product dispenser comprising:

a product container for storing the product to be dispensed, the container defining an opening through which the product can exit the container, the container terminating in a spout;

a product flow regulator proximate the container opening, the product flow regulator comprising a flow passage that is in communication with the product container, the flow passage for accommodating the product when exiting the container, the product flow regulator terminating in at least one distribution aperture for allowing the product within the flow passage to exit the product flow regulator, the product flow regulator further comprising a reservoir for accommodating the product exiting the product flow regulator; wherein the product flow regulator comprises a conduit that defines the flow passage, the conduit comprising a first, open end snugly fitted within the spout of the product container to receive product exiting the container, and a second end in which the at least one distribution aperture is defined and a rectangular bowl portion extending from the conduit, proximate the second end of the conduit, the bowl portion defining the reservoir for accommodating the product exiting the product flow regulator through the at least one distribution aperture a dispensing cover overlying the product flow regulator, the dispensing cover defining an elongate distribution slit proximate the reservoir of the product flow regulator, for allowing an elongate product strip to be dispensed, wherein the at least one distribution aperture faces sideways, or downwards towards the base of the bowl portion and opposite the overlying slit, thereby ensuring that the reservoir is filled completely before the product is dispensed through the elongate distribution slit.

2. The product dispenser of claim 1, wherein the reservoir is substantially elongate, and is positioned substantially parallel to the elongate distribution slit of the dispensing cover.

3. The product dispenser of claim 1, wherein the product container comprises a spout that defines the container opening, the product flow regulator being securable to the spout of the product container.

4. The product dispenser of claim 3, wherein the product flow regulator further comprises a skirt extending from the conduit, proximate the first end of the conduit, the skirt and spout comprising complementary securing formations to enable the skirt, and thus the product flow regulator, to be secured to the spout of the product container.

5. The product dispenser of claim 4, wherein the dispensing cover and the skirt comprise complementary securing formations to enable the dispensing cover to be secured to the product flow regulator.

6. The product dispenser of claim 1, wherein proximate the elongate distribution slit, the dispensing cover comprises a rectangular guide wall that can be snugly accommodated within the rectangular bowl portion of the product flow regulator, thereby guiding the flow of product from the reservoir through the elongate distribution slit.

7. The product dispenser of claim 1, wherein the product container comprises a flexible wall container.

8. The product dispenser of claim 7, wherein the flexible wall container is a tube.

9. The product dispenser of claim 1, wherein the product container comprises a rigid wall container fitted with a dispensing mechanism.

10. The product dispenser of claim 1, wherein the product dispenser comprises a cap that is releasably fittable to the dispensing cover.

* * * * *